United States Patent [19]

Gitlin et al.

[11] Patent Number: 4,828,096

[45] Date of Patent: May 9, 1989

[54] COIN SLIDE

[75] Inventors: Harvey S. Gitlin, Ambler; Evan C. Wilfong, Huntingdon Valley, both of Pa.

[73] Assignee: Equipment Systems and Devices, Inc., Dresher, Pa.

[21] Appl. No.: 69,160

[22] Filed: Jul. 2, 1987

[51] Int. Cl.[4] ..... G07F 5/06

[52] U.S. Cl. ..... 194/200; 194/235; 194/257

[58] Field of Search ..... 194/200, 201, 202, 204, 194/235, 238, 257, 291, 343

[56] References Cited

U.S. PATENT DOCUMENTS 4,499,983 2/1985 Gitlin et al. ..... 194/343

4,515,262 5/1985 Wilfong et al. ..... 194/343

*Primary Examiner*—F. J. Bartuska

*Attorney, Agent, or Firm*—Steele, Gould & Fried

[57] ABSTRACT

An improved coin slide is disclosed which incorporates a transverse stop bar formed in the bottom of the slide. The stop bar is positioned to overlie the lever checking mechanism when the slide is moved to its rearward vending position whereby in the event of a broken lever, the lever will be automatically spring biased into contact with the stop bar to prevent forward movement of the slide. Additionally, the slide is provided with a pair of transversely spaced hold down pads which are positioned on the slide top surface to contact with bridge trailing surface for slide stabilization precisely when the bridge is performing its coin checking function.

4 Claims, 2 Drawing Sheets

COIN SLIDE

BACKGROUND OF THE INVENTION

1. Field of the Invention

The present invention relates generally to the field of coin accepting mechanisms for use in the vending machine industry, and more particularly, is directed to an improved, vertical coin slide capable of accepting and processing a plurality of coins in side by side, vertical, transversely spaced arrangement.

2. Discussion of the Prior Art

Coin slides have long been utilized in the vending machine industry to accept coins, to check the coins for denomination and authenticity prior to vending and then to receive and store the coins following vending for later collection by the owner or manager of the establishment. More recently, as prices have begun to rise and as vending operations have become more costly, the need has arisen to provide coin slides capable of accepting increased numbers of coins. More recent improvements in the coin slide industry have been directed toward accepting coins in vertical orientation to thereby conserve space and to present a device that is both compact and reliable. Additionally, improved means have been incorporated to allow the vending price to be easily changed by the operator without requiring special skills or special tools.

As set forth in U.S. Pat. Nos. 4,350,240, 4,401,202 and 4,499,983, which patents are owned by the assignee of the present application, improved facilities have now been designed which render the existing vertical type coin slides capable of rapid and easy price adjustment to thereby enable vending machine operators to quickly adjust the coin slides to either a higher vending price or to a lower vending price, in accordance with day-to-day marketplace requirements. Interchangeable cores are provided to allow price adjustment without major disassembly of the component parts of the coin slide While the devices of U.S. Pat. Nos. 4,350,240, 4,401,202 and 4,499,983 incorporated many improved construction features which were particularly designed to minimize the acceptance of bad coins and to discourage tampering, experience has proved that even such improved coin slides could sometimes be manipulated in a manner to retrieve the inserted coins after the vending cycle had been initiated or to depress one or more coin checking levers without using coins. The present invention incorporates additional construction features to prevent such unauthorized tampering and withdrawal of the vended coins.

SUMMARY OF THE INVENTION

The present invention relates generally to the field of coin slides for coin operated vending machines, and more particularly, is directed to an improved vertical coin slide featuring improved means to discourage tampering.

The coin slide of the present invention includes a body having an integral flange for securely mounting the coin slide in the vending machine. An integral handle and slide plate is longitudinally movable relative to the body and is provided with a plurality of elongated slots for selectively receiving therein any one of a plurality of interchangeable cores for easily setting the vending price.

The interchangeable cores receive coins of predetermined denomination therein to make up the established vend price. When the required coins are properly positioned in the interchangeable cores, the slide may be rearwardly pushed in known manner and the coins pass through coin receiving grooves in the slide mounting flange whereat an initial coin size check is made.

As set forth in U.S. Pat. Nos. 4,350,240 and 4,401,202, a bridge is provided rearwardly of the mounting flange in position to be contacted by the vertically oriented coins after they pass through the mounting flange. The bridge is formed with interior configured surfaces or cams to force the coins downwardly through the core openings to activate levers of the usual lever checking mechanism. The slide of the present invention incorporates a novel pair of laterally spaced hold down pads which are designed and positioned to contact the rearward edge of the bridge in a manner to level the slide and to hold the slide at precisely the correct height for accurately sizing the coins. By providing the hold down pads in the slide, any looseness that may be present between the slide and the body will be accommodated to thereby provide accurate coin checking at exactly the moment when the coins are downwardly urged by the bridge cams.

The improved coin slide of the present invention further incorporates an additional structural barrier interiorly of the mounting flange to prevent operation of the slide in the event of breakage of one or more of the coin checking levers. The lever spring, in the event of breakage, will continually bias the broken lever portion upwardly into engagement with the barrier, whereby the slide will be jammed and any additional slide movement will be positively prevented.

It is therefore an object of the present invention to provide an improved coin slide of the type set forth.

It is another object of the present invention to provide a novel, improved coin slide which includes a barrier formed in the slide in position to be contacted by a broken coin checking lever so as to jam the mechanism and to positively prevent any additional slide movement in the event of lever breakage.

It is another object of the present invention to provide a novel, improved slide which comprises a slide leveling means operable in conjunction with the rear terminus of the bridge to restrain any looseness between the slide and the body at precisely the correct time and location to assure improved coin checking accuracy.

It is another object of the present invention to provide a novel improved coin slide that is relatively simple in construction, virtually tamper-proof when installed and trouble free when in use.

Other objects and a fuller understanding of the invention will be had by referring in the following description and claims of a preferred embodiment thereof, taken in conjunction with the accompanying drawings, wherein like reference characters refer to similar parts throughout the several view and in which:

DESCRIPTION OF THE PREFERRED EMBODIMENT OF THE INVENTION

Figure 1:
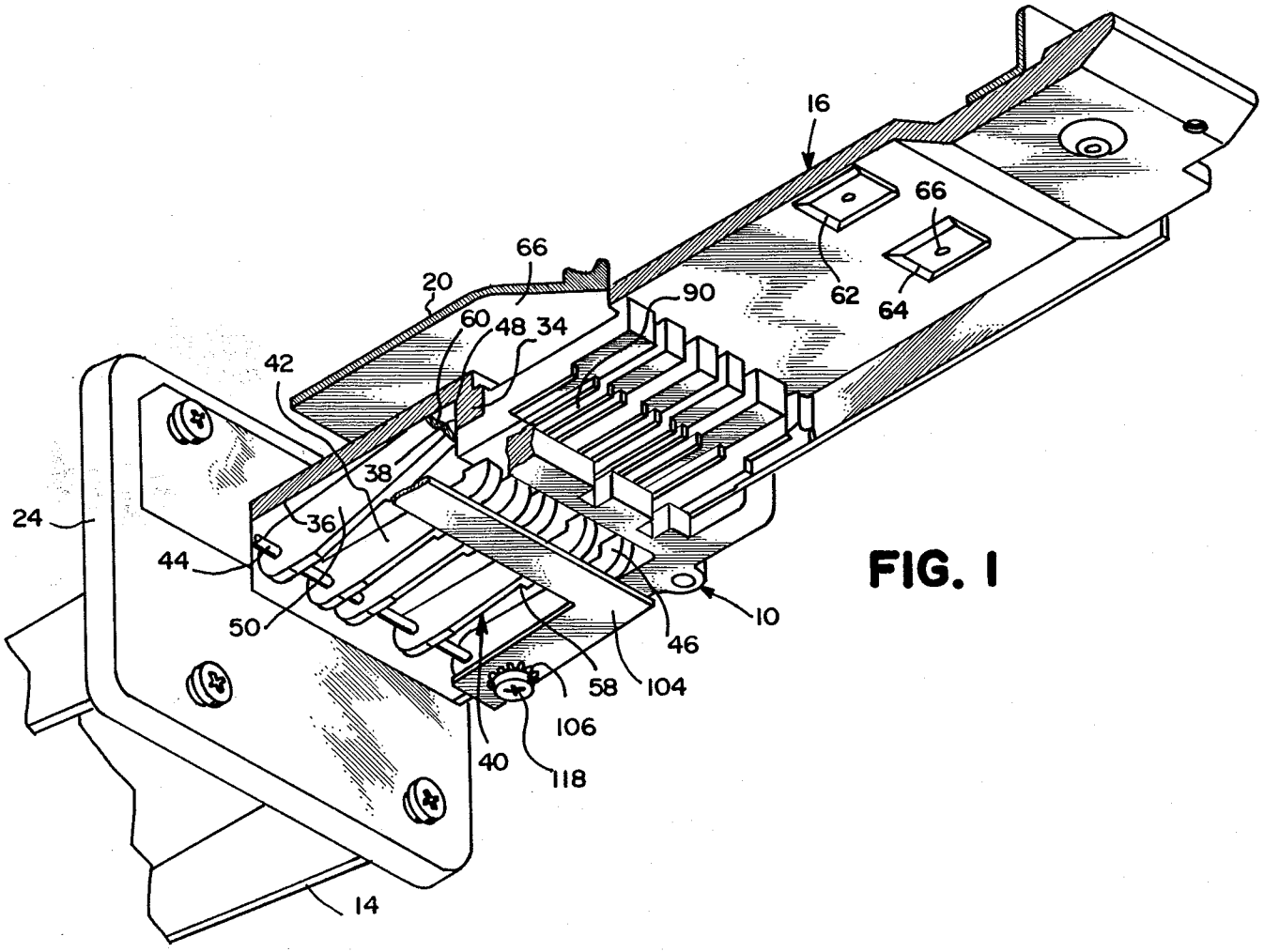
FIG. 1 is a partial, bottom perspective view of a coin slide constructed in accordance with the present invention, and partly broken away to expose interior construction details.

Although specific terms are used in the following description for the sake of clarity, these terms are intended to refer only to the particular structure of the invention selected for illustration in the drawings and are not intended to define or limit the scope of the invention.

Referring now to the drawings, there is illustrated in FIG. 1 a coin slide generally designed 10 which is suitable for initiating the vending cycle in numerous types of vending machines, for example, washing machines and drying machines (not shown) of the type generally installed in coin operated laundries, apartment buildings and the like.

The coin slide 10 comprises generally a sturdy body 14 which incorporates an integral mounting flange 24 for securing the coin slide to a front panel of a vending machine (not shown) in the usual manner. A slide 16 includes a forward handle 18 and is movable longitudinally of the body 14 for vending machine operation purposes upon the insertion of the correct number and denomination of coins, in well known manner.

Figure 2:
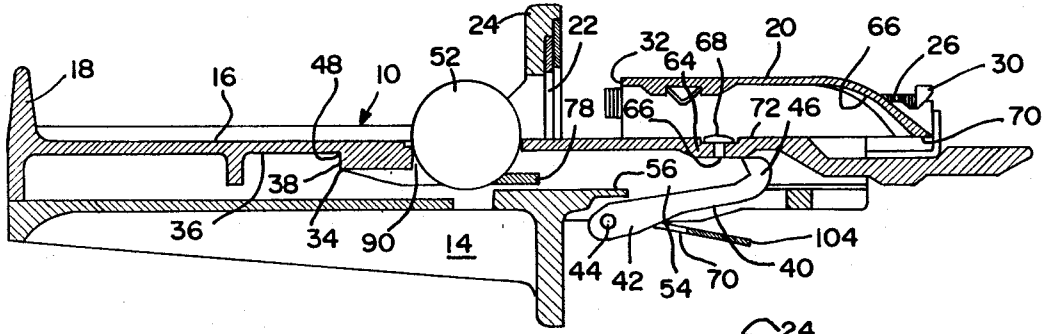
FIG. 2 is a cross-sectional view on reduced scale showing the position of the slide during the coin insertion operation.

As shown in FIG. 2, it will be observed that the mounting flange 24 is equipped with coin receiving grooves 22 in longitudinal alignment with the central axes of the respective coin receiving openings 90 which are provided in the slide 16 whereby the coin receiving grooves 22 can provide an additional coin checking function. So long as a coin 52 can insert within a coin receiving opening 90 in the slide 16 and through the coin receiving groove 22 in the mounting flange 24, there will be no resistance to rearward movement of the slide 16 toward initiation of the vending cycle.

In known manner, a pair of operating springs 26 bias between respective lugs 30 which are rearwardly affixed on the slide 18 and stationary portions 32 of the bridge 20. The springs 26, normally bias the slide 18 to an initial, forward, coin accepting position, as illustrated in FIG. 2. When the slide 18 is urged rearwardly upon insertion of a correct plurality of coins 52 within the coin receiving openings 90, the bias of the springs 26 must be overcome by rearwardly directed forces on the handle applied by the hand of the user (not shown) in the known manner.

As the slide 16 is pushed to feed the coins rearwardly of the flange 24 through the coin receiving grooves 22 therein, the shaped interior surfaces 66 of the bridge 20, which may be cams, function to force the coins 52 downwardly through the elongated coin receivers 54 of the lever checking mechanism 40. The downward pressure exerted by each coin 52 acts upon a respective lever 42 against the bias of a spring finger of a leaf spring (not shown), in known manner, to pivot each lever hook 46 about the pivot shaft 44 to depress the lever hooks downwardly through the coin receivers 54 until the entire hook configuration 46 of each lever is urged downwardly below the plane of the lever checking mechanism top surface 56. When all of the hooks 46 have been pushed below the planar top surface 56, the respective locking edges 78 at the coin receiving openings 90 cannot engage the hooks 46 because the locking edges ride rearwardly above the top surface 56. See FIGS. 3 and 4. Therefore, the slide 16 can then be pushed further rearwardly toward vending contact.

In order to prevent tampering with the levers 42 by manipulating a tool through the flange openings 22, a sturdy, bottom positioned coin stripper plate 104 has been provided below the lever checking mechanism 40. By so positioning the coin stripper plate 104, any tampering by inserting a tool to pivot one or more levers 42 about the common pivot shaft 44 can thus be discouraged by limiting the freedom of movement of the coin checking levers.

As illustrated in FIG. 1, the coin stripper plate 104 can be provided with laterally positioned openings 106, to receive therethrough a mounting bolt 118. The mounting bolts 118 can then be threadedly secured within left and right threaded openings provided in the body 14 to secure the coin stripper plate in a simplified and sturdy interconnection.

Figure 4:
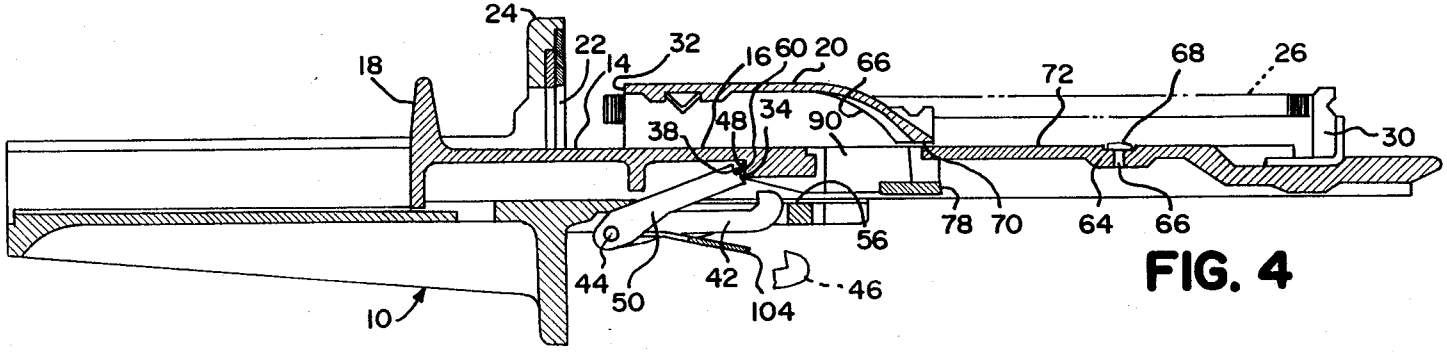
FIG. 4 is a cross-sectional view similar to FIG. 2 showing the slide in jammed condition with a broken locking lever.

In the event of breakage of one or more levers 42 of the lever checking mechanism 40, for example by use of a prying tool in an attempt to vandalize the mechanism, a sturdy, depending, integral stop bar or catch 34 has been provided to engage the broken lever in a manner to jam the slide operation. As best seen in FIGS. 1 and 4, the stop bar 34 is formed in the bottom 36 of the slide 16 immediately forwardly of the coin receiving openings 90. The stop bar comprises a vertical stop surface 38 which terminates upwardly in a sharp corner 48 at the intersection with the planar slide bottom surface 36.

As shown, when a locking lever 42 is broken, for example, by breaking off the lever hook 46, the remainder of the lever body 50 will be urged upwardly about the pivot shaft 44 under urging of the conventional leaf spring 58. The broken lever end 60 will be urged above the lever checking mechanism top surface 56 and into engagement with the stop bar 34 at the vertical surface 38 and the sharp corner 48 thereof. As best seen in FIG. 4, when the broken lever end 60 is engaged with the stop bar or catch 34, forward movement of the slide 16 will be absolutely prohibited. Accordingly, the attempt to vandalize the machine by breaking the lever checking mechanism must fail.

Figure 3:
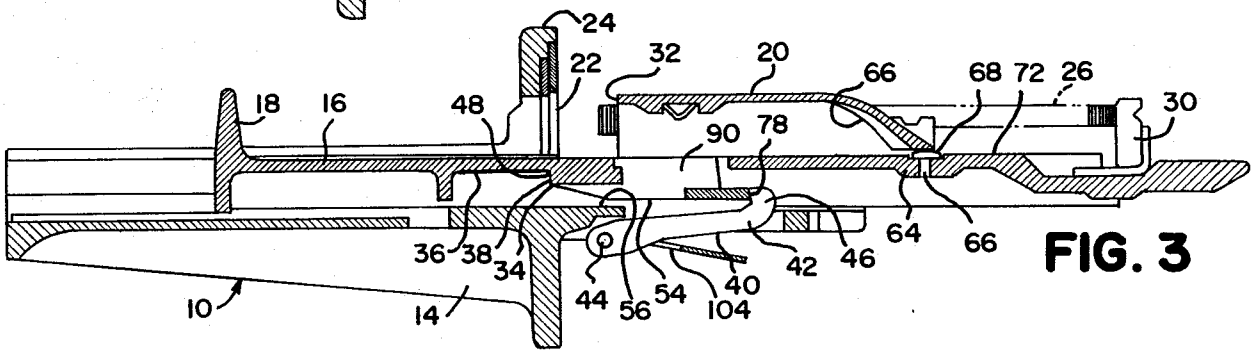
FIG. 3 is a cross-sectional view similar to FIG. 2 showing the position of the parts when the hold down pads contact the bridge.

Referring now to FIG. 1 and FIG. 3, the slide 16 is designed with a pair of depending bosses 62, 64 to provide additinal material to support the pins 66 of slide hold down pads 68. As illustrated, the top surfaces of the pads 68 are rounded and rise slightly above the planar top surface 72 of the slide 16. These hold down pads are intended to rise above the slide surface sufficiently to bear against and contact momentarily the bottom trailing edge 70 of the bridge 20 as the slide is urged rearwardly toward its vending position when the proper coins are inserted. The pads 68 are provided to level and stabilize the slide relative to the bridge 20 during the critical short period when the bridge is performing its coin verification function. By so controlling any loosensss or any tendency of the slide to vertically move relative to the bridge during coin checking, greater accuracy can be achieved, thereby additionally discouraging any attempt to employ anything other than a genuine coin of the proper denomination. It will be appreciated that the height of the hold down pads 68 relative to the slide top surface 72 can be readily, precisely adjusted by employing shims (not shown) in the well known manner to thereby assure extremely accurate coin checking.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a coin slide of the type having a body with integral mounting flange adapted to be mounted upon a vending machine, a slide having coin receiving openings to receive coins in vertical orientation, the slide having a planar top surface and being movable relative to the body between a forward, coin receiving position and a rearward, vending position, a lever checking mechanism affixed to the body rearwardly of the mounting flange, the lever checking mechanism having a plurality of spring biased levers which are positioned to be depressed by the coins as the slide is moved toward its vending position, and a coin contacting bridge secured to the body rearwardly of the mounting flange and above the lever checking mechanism, the planar top surface of the slide being movable below the bridge, the improvement comprising:

a stop bar formed in the bottom of the slide immediately forwardly of the coin receiving openings in position to overlie the lever checking mechanism when the slide is moved to the said rearward, vending position;

the stop bar comprising a vertical stop surface, the stop bar being adapted to be engaged by a lever of the lever checking mechanism in the event that a lever becomes broken; and;

whereby the engagement of the broken lever upon the stop bar will prevent forward movement of the slide from its rearward position towards its said forward position.

2. The coin slide of claim 1, wherein the stop bar depends from the slide bottom and wherein the vertical stop surface terminates upwardly in a sharp corner.

3. The coin slide of claim 2, wherein the sharp corner is positioned at the intersection of the vertical stop surface and the slide bottom.

4. The coin slide of claim 1, wherein the hold down pad is secured in the slide, the hold down pad comprising a mounting pin and an integral, rounded pad, a portion of the rounded head extending above the planar top surface of the slide.

* * * * *

UNITED STATES PATENT AND TRADEMARK OFFICE

CERTIFICATE OF CORRECTION

PATENT NO. : 4,828,096

DATED : May 9, 1989

INVENTOR(S) : Harvey S. Gitlin and Evan C. Wilfong

It is certified that error appears in the above-identified patent and that said Letters Patent is hereby corrected as shown below:

Column 6, line 9, after "and;" insert

--a hold down pad secured in the slide to level and stabilize the slide relative to the body when the coins contact the bridge, the hold down pad extending above the planar top surface of the slide, the pad being positioned to contact a portion of the bridge when the slide is moved to its said rearward, vending position to level and stabilize the slide relative to the body when the coins contact the bridge;--.

Signed and Sealed this

Twenty-second Day of May, 1990

*Attest:*

HARRY F. MANBECK, JR.

*Attesting Officer*

*Commissioner of Patents and Trademarks*